US011112714B2

(12) United States Patent
Amano et al.

(10) Patent No.: US 11,112,714 B2
(45) Date of Patent: Sep. 7, 2021

(54) TONER

(71) Applicant: CANON KABUSHIKI KAISHA, Tokyo (JP)

(72) Inventors: Shota Amano, Yokohama (JP); Shintaro Kawaguchi, Yokohama (JP); Kenichi Nakayama, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/808,782

(22) Filed: Mar. 4, 2020

(65) Prior Publication Data

US 2020/0292956 A1 Sep. 17, 2020

(30) Foreign Application Priority Data

Mar. 14, 2019 (JP) ..... JP2019-046883

(51) Int. Cl.
*G03G 9/08* (2006.01)
*G03G 9/097* (2006.01)
*G03G 9/10* (2006.01)

(52) U.S. Cl.
CPC ..... *G03G 9/09725* (2013.01); *G03G 9/09708* (2013.01); *G03G 9/10* (2013.01)

(58) Field of Classification Search
CPC ..... G03G 9/09725; G03G 9/09708
USPC ..... 430/108.6, 108.7
See application file for complete search history.

(56) References Cited

U.S. PATENT DOCUMENTS

| | | | |
|---|---|---|---|
| 6,214,509 | B1 | 4/2001 | Kasuya et al. |
| 6,316,157 | B1 | 11/2001 | Yoshikawa et al. |
| 6,346,356 | B1 | 2/2002 | Ohno et al. |
| 7,112,393 | B2 | 9/2006 | Komoto et al. |
| 7,153,625 | B2 | 12/2006 | Kaburagi et al. |
| 7,241,546 | B2 | 7/2007 | Moriki et al. |
| 7,387,860 | B2 | 6/2008 | Moriki et al. |
| 7,846,631 | B2 | 12/2010 | Katsuta et al. |
| 8,822,120 | B2 | 9/2014 | Abe et al. |
| 8,828,639 | B2 | 9/2014 | Kamikura et al. |
| 8,841,056 | B2 | 9/2014 | Yoshizaki et al. |
| 9,423,714 | B2 | 8/2016 | Kenmoku et al. |
| 9,921,501 | B2 | 3/2018 | Mochizuki et al. |
| 2006/0204876 | A1 | 9/2006 | Kaburagi et al. |
| 2010/0035171 | A1 | 2/2010 | Watanabe et al. |
| 2011/0008726 | A1 | 1/2011 | Katsuta et al. |
| 2015/0248072 | A1 | 9/2015 | Katsuta et al. |
| 2017/0123333 | A1 | 5/2017 | Kuroki et al. |
| 2019/0064686 | A1* | 2/2019 | Terauchi ..... G03G 9/0975 |
| 2019/0235402 | A1 | 8/2019 | Inoue et al. |
| 2019/0332027 | A1 | 10/2019 | Kenmoku et al. |

FOREIGN PATENT DOCUMENTS

| | | |
|---|---|---|
| EP | 0957407 | 11/1999 |
| JP | 2000-035692 | 2/2000 |
| JP | 2018-040967 | 3/2018 |

OTHER PUBLICATIONS

U.S. Appl. No. 16/814,100, Kenichi Nakayama, filed Mar. 10, 2020.

* cited by examiner

*Primary Examiner* — Mark A Chapman
(74) *Attorney, Agent, or Firm* — Venable LLP

(57) ABSTRACT

A toner comprising: a toner particle; and an external additive, wherein the external additive includes spherical silica particles and hydrotalcite particles, a number average particle diameter Da of the spherical silica particles is from 10 nm to 40 nm, a circularity of the spherical silica particles is at least 0.80, and the toner satisfies formula (1) below:

$$\{Ga\times(1-Ka/100)\}/\{Gb\times(1-Kb/100)\}\geq 0.050 \quad (1)$$

wherein Ga: a content of the spherical silica particles with respect to 100 parts by mass of the toner particle; Gb: a content of the hydrotalcite particles with respect to 100 parts by mass of the toner particle; Ka: a fixing ratio (%) of the spherical silica particles on a surface of the toner particle; and Kb: a fixing ratio (%) of the hydrotalcite particles on the surface of the toner particle.

9 Claims, No Drawings

TONER

BACKGROUND OF THE INVENTION

Field of the Invention

The present invention relates to a toner suitable for an image forming method such as electrophotography.

Description of the Related Art

In recent years, copying machines and printers have been required to produce stable images without deterioration in image quality in any environment in addition to downsizing, high speed, and long life.

In order to meet such a demand, a toner using hydrotalcite particles having high charge-providing ability even under high temperature and high humidity as an external additive has been suggested.

Japanese Patent Application Publication No. 2000-35692 suggests that a toner having excellent properties even under high temperature and high humidity can be obtained by externally adding hydrotalcite particles to the toner. It is indicated that where a hydrotalcite particle is present on the surface of a toner particle, the hydrotalcite particle can increase the charge by acting as a microcarrier when the charge is decayed.

Although the above toner exhibits excellent charging characteristics, a problem is associated with high durability. Specifically, where the toner in the developing machine is rubbed strongly during high-speed printing, the hydrotalcite particle may be detached from the toner particle, resulting in contamination of parts in the developing machine.

Japanese Patent Application Publication No. 2018-40967 discloses a method for preventing the detachment of hydrotalcite particles by combining spherical particles and hydrotalcite particles and electrostatically interacting these materials.

SUMMARY OF THE INVENTION

However, when further increase in the speed and life of the developing device was intensively investigated by the present inventors, it was understood that where the technique disclosed in the abovementioned patent literature is used, aggregated lumps are easily formed by hydrotalcite particles and other external additives in the latter half of the endurance use. It was also understood that development streaks starting from the aggregated lumps occur. It was further understood that the charge-providing function of the hydrotalcite particles is lost due to the generation of the aggregated lumps.

The present invention provides a toner capable of maintaining high image quality even in long-term use regardless of the environment.

As a result of intensive investigation conducted to solve the above problems, the present inventors have found that the above problems can be solved by the following toner.

A toner comprising:

a toner particle; and an external additive, wherein the external additive includes spherical silica particles and hydrotalcite particles, a number average particle diameter Da of the spherical silica particles is from 10 nm to 40 nm, a circularity of the spherical silica particles is at least 0.80, and the toner satisfies formula (1) below:

$$\{Ga\times(1-Ka/100)\}/\{Gb\times(1-Kb/100)\}\geq 0.050 \quad (1)$$

wherein

Ga: a content of the spherical silica particles with respect to 100 parts by mass of the toner particle;

Gb: a content of the hydrotalcite particles with respect to 100 parts by mass of the toner particle;

Ka: a fixing ratio (%) of the spherical silica particles on a surface of the toner particle; and Kb: a fixing ratio (%) of the hydrotalcite particles on the surface of the toner particle.

According to the present invention, it is possible to provide a toner capable of maintaining high image quality even in long-term use regardless of the environment.

Further features of the present invention will become apparent from the following description of exemplary embodiments.

DESCRIPTION OF THE EMBODIMENTS

Unless otherwise specified, descriptions of numerical ranges such as "from XX to YY" or "XX to YY" in the present invention include the numbers at the upper and lower limits of the range.

The present invention is explained in detail below.

The present invention relates to a toner comprising:

a toner particle; and an external additive, wherein the external additive includes spherical silica particles and hydrotalcite particles, a number average particle diameter Da of the spherical silica particles is from 10 nm to 40 nm, a circularity of the spherical silica particles is at least 0.80, and the toner satisfies formula (1) below:

$$\{Ga\times(1-Ka/100)\}/\{Gb\times(1-Kb/100)\}\geq 0.050 \quad (1)$$

wherein

Ga: a content of the spherical silica particles with respect to 100 parts by mass of the toner particle;

Gb: a content of the hydrotalcite particles with respect to 100 parts by mass of the toner particle;

Ka: a fixing ratio (%) of the spherical silica particles on a surface of the toner particle; and Kb: a fixing ratio (%) of the hydrotalcite particles on the surface of the toner particle.

The present inventors have identified the following reason why the effect of the present invention can be obtained by satisfying the above conditions.

In the case of an ordinary non-spherical silica particles, the contact area with the hydrotalcite particles is large and an aggregated lump can be easily formed, but where the abovementioned specific spherical silica particle is used in a range where the relationship of the fixing ratio satisfies the formula (1), the formation of the aggregate lumps can be prevented. As a result, the occurrence of development streaks due to aggregated lumps can be eliminated and the function of the hydrotalcite particle can be continuously exhibited in the latter half of durable use.

The number average particle diameter (Da) of the spherical silica particles is from 10 nm to 40 nm. When the number average particle diameter is in the above range, silica particles enter the aggregated lumps of the hydrotalcite particles, and therefore the structure is more nonuniform than the aggregated lumps formed by the hydrotalcite particles alone. As a result, the aggregated lumps are easily broken even by the force applied in the developing machine.

The number average particle diameter (Da) of the spherical silica particles is preferably from 12 nm to 38 nm, and more preferably from 14 nm to 36 nm.

Also, the circularity of the spherical silica particle needs to be at least 0.80. Within the above range, the contact area with the hydrotalcite particles is smaller than that in the case of non-spherical silica particles, and the disaggregation of the aggregated lumps can be facilitated.

The circularity of the spherical silica particle is preferably at least 0.85, and more preferably at least 0.90. Meanwhile, the upper limit is not particularly limited, but is preferably not more than 0.99, and more preferably not more than 0.98. The circularity of the spherical silica particles can be controlled by the conditions during the production of the external additive. For example, the circularity can be controlled to the above range by the difference in surface tension between the raw material monomer and the reaction field.

Furthermore, the toner of the present invention needs to satisfy the following formula (1). Where the formula (1) is satisfied, a certain amount of spherical silica particles that are not fixed to the toner particle surface is present in the developing machine while moving between the toner particles. In such a state, spherical silica particles can penetrate into the aggregated lumps of hydrotalcite particles, and the effect which prevents the generation of aggregated lumps (aggregation prevention effect) will be demonstrated. As a result, the hydrotalcite is less likely to form aggregated lumps, and the function thereof as a microcarrier can be maintained.

Where the value of the formula (1) is less than 0.050, the amount of spherical silica particles that can move between the toner particles is small and there is no aggregation prevention effect, so that the aggregated lumps are generated and image defects are caused as development streaks.

The value of the formula (1) is preferably not more than 6.000. That is, it is preferable that the following formula (1') be satisfied.

Further, the value of the formula (1) is preferably at least 0.500. Meanwhile, the upper limit is more preferably not more than 2.000. The addition effect of the hydrotalcite particles can be easily obtained because the amount of the spherical silica particles transferred from the toner is not excessively larger than the amount of the hydrotalcite particles that are weakly fixed to the toner particle surface.

$$\{Ga\times(1-Ka/100)\}/\{Gb\times(1-Kb/100)\}\geq 0.050 \quad (1)$$

$$6.000\geq\{Ga\times(1-Ka/100)\}/\{Gb\times(1-Kb/100)\}\geq 0.050 \quad (1')$$

Ga: a content of the spherical silica particles with respect to 100 parts by mass of the toner particle;

Gb: a content of the hydrotalcite particles with respect to 100 parts by mass of the toner particle;

Ka: a fixing ratio (%) of the spherical silica particles on the surface of the toner particle; and Kb: a fixing ratio (%) of the hydrotalcite particles on the surface of the toner particle.

The content of the spherical silica particles is preferably from 0.10 parts by mass to 5.00 parts by mass, and more preferably from 0.5 parts by mass to 1.5 parts by mass with respect to 100 parts by mass of the toner particles.

Where the content of the spherical silica particles is 0.10 parts by mass or more, the effect of preventing the aggregation of the spherical silica particles is easily exhibited. Meanwhile, where the content of the spherical silica particles is 5.00 parts by mass or less, the spherical silica particles tend to be fixed uniformly and firmly on the toner particle surface, and the function of the hydrotalcite particles exhibiting a microcarrier-like function is easily expressed.

The fixing ratio Ka of the spherical silica particles on the toner particle surface is preferably from 60% to 95%, and more preferably from 70% to 85%. Where the fixing ratio is 60% or more, the microcarrier function of the hydrotalcite particles is easily expressed, and when the fixing ratio is 95% or less, the effect of preventing the formation of aggregates is exhibited. The fixing ratio Ka can be controlled by the number average particle diameter, the addition amount, and the external addition intensity.

Further, the ratio Db/Da of the number average particle diameter Db of the hydrotalcite particles to the number average particle diameter Da of the spherical silica particles is preferably at least 7.5, and more preferably at least 8.0. Meanwhile, the upper limit is not particularly limited, but is preferably not more than 35.0, and more preferably not more than 30.0.

When Db/Da is 7.5 or more, the effect of the present invention is more easily obtained. This is because the hydrotalcite particles are sufficiently large as compared to the spherical silica particles, and even when a small amount of spherical silica particles adheres to the hydrotalcite particles, it is difficult to cause a decrease in the function of the hydrotalcite particles.

Hereinafter, the silica particles used in the present invention will be described.

Silica particles can be exemplified by wet silica produced from water glass, sol-gel silica particles produced by a sol-gel method, gel method silica particles, aqueous colloidal silica particles, alcoholic silica particles, and fused silica particles obtained by a gas phase method, explosion method silica particles, and the like. Since the degree of circularity is high and the particle size distribution is sharp, sol-gel silica particles are preferred, and sol-gel silica particles that have been hydrophobized are particularly preferred.

Examples of the hydrophobizing agent include unmodified silicone varnish, various modified silicone varnishes, unmodified silicone oil, various modified silicone oils, silane compounds, silane coupling agents, other organosilicon compounds, and organotitanium compounds. These treatment agents may be used alone or in combination.

The number average particle diameter Db of the hydrotalcite particles is preferably from 0.10 μm to 1.00 μm, and more preferably from 0.20 μm to 0.80 μm. When Db is 0.10 μm or more, the effect of maintaining the charge by the hydrotalcite particle acting as a microcarrier is improved. Meanwhile, when Db is 1.00 μm or less, the hydrotalcite particles are less likely to be detached from the toner particle, and aggregated lumps starting from the hydrotalcite are less likely to be generated.

The hydrotalcite particles are preferably hydrophobized with a surface treatment agent in order to improve environmental stability. As the surface treatment agent, higher fatty acids, coupling agents, esters, and oils such as silicone oil can be used. Of these, higher fatty acids are preferably used, and specific examples thereof include stearic acid, oleic acid, and lauric acid.

The content of the hydrotalcite particles is preferably from 0.05 parts by mass to 1.00 parts by mass, and more preferably from 0.10 parts by mass to 0.80 parts by mass with respect to 100 parts by mass of the toner particles.

When the amount added is 0.05 parts by mass or more, the function of the hydrotalcite particles is easily expressed, and fogging can be prevented from the initial durability stage. When the amount is 1.00 parts by mass or less, the hydrotalcite particles can be easily fixed uniformly to the toner particle surface, and development streaks due to contamination of parts caused by the generation of aggregated lumps can be prevented.

The fixing ratio Kb of the hydrotalcite particles on the toner particle surface is preferably from 15% to 70%, and more preferably from 15% to 65%. When Kb is 15% or more, it is easy to prevent the generation of aggregated lumps, and it is also effective for preventing the contamination of parts such as a developing blade. When the fixing ratio is 70% or less, the function of a microcarrier is likely to be expressed. The fixing ratio Kb can be controlled by the number average particle diameter, the amount added, and the external addition intensity.

Hydrotalcite particles are not particularly limited as long as the above characteristics are satisfied, but particles represented by the following structural formula can be used.

$$M^{2+}_{y}M^{3+}_{x}(OH)_2A^{n-}_{(x/n)}\cdot mH_2O$$

($M^{2+}$ represents a divalent metal ion, $M^{3+}$ represents a trivalent metal ion, $A^{n-}$ represents an n-valent anion, $0<x\leq 0.5$, $x+y=1$, and $m\geq 0$.)

The divalent metal ion and the trivalent metal ion may be a solid solution including a plurality of different elements, or may include a small amount of a monovalent metal ion in addition to these metal ions.

Examples of metals that give divalent metal ions include Mg, Zn, Ca, Ba, Ni, Sr, Cu, and Fe. Examples of metals that give trivalent metal ions include Al, B, Ga, Fe, and Co, and In. As the divalent metal ion, $Mg^{2+}$ is preferable, and as the trivalent metal ion, $Al^{3+}$ is preferable.

The n-valent anions can be exemplified by $CO_3^{2-}$, $OH^-$, $Cl^-$, $P^-$, $F^-$, $Br^-$, $SO_4^{2-}$, $HCO_3^{2-}$, $CH_3COO^-$, and $NO_3^-$, and these may be present alone or in a combination of a plurality thereof.

The hydrotalcite particle is represented by, for example, $Mg_6Al_2(OH)_{16}CO_3\cdot 4H_2O$. The production method of the hydrotalcite particles is not particularly limited, a known method can be adopted, and a natural product or an artificial product may be used.

In addition to the spherical silica particles and hydrotalcite particles, organic or inorganic fine particles generally known as external additives may be added to the toner. In this case, it is preferable that the total amount of inorganic particles and organic particles including the hydrotalcite particles be from 0.5 parts by mass to 5.0 parts by mass with respect to 100 parts by mass of the toner particles. Where the total amount of the fine particles is 0.5 parts by mass or more, the flowability of the toner is good, and where the total amount of the fine particles is 5.0 parts by mass or less, contamination of the parts by the toner and external additives can be prevented.

As the inorganic fine particles externally added to the toner particles, in addition to the spherical silica particles and the hydrotalcite particles, for example, inorganic particles selected from silica, alumina, titania, or composite oxides thereof can be used. Examples of the composite oxides include silica-alumina composite oxide, silica-titania composite oxide, strontium titanate particles and the like.

These external additives are preferably used after the surface thereof has been hydrophobized. Examples of the hydrophobizing treatment include a treatment with an organosilicon compound, silicone oil, long-chain fatty acid and the like.

Examples of the organosilicon compound include hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, hexamethyldisilane and the like. These can be used alone or in a mixture of two or more kinds thereof.

Examples of the silicone oil include dimethyl silicone oil, methylphenyl silicone oil, α-methylstyrene-modified silicone oil, chlorophenyl silicone oil, and fluorine-modified silicone oil.

The toner can also further include other additives, for example, a lubricating agent such as Teflon (registered trademark) powder, zinc stearate powder, polyvinylidene fluoride powder, an abrasive agent such as cerium oxide powder and silicon carbide powder, an anti-caking agent, and fine organic particles. These additives can also be used after hydrophobizing the surface.

Examples of the organic fine particles include homopolymers or copolymers of monomer components that are used in toner binder resins, such as styrene, acrylic acid, methyl methacrylate, butyl acrylate, and 2-ethylhexyl acrylate, which are obtained by, for example, emulsion polymerization or spray drying.

The toner particle production method is not particularly limited, and a known method can be adopted. For example, a method for directly producing a toner in a hydrophilic medium, such as an emulsion aggregation method, a dissolution suspension method, or a suspension polymerization method, can be mentioned. Further, a pulverization method may be used, and the toner obtained by the pulverization method may be subjected to hot spheroidization.

Among them, with the toner produced by the emulsion aggregation method, the effect of the present invention can be easily obtained. That is, the toner particles are preferably emulsion aggregation toner particles. The reason is that the flocculant used in the production process has polyvalent metal ions. The presence of this polyvalent metal ion in the binder resin allows the generated charge to be dispersed inside the toner, and charging performance of the toner can be further stabilized. The polyvalent metal ion is preferably at least one selected from the group consisting of aluminum ion, iron ion, magnesium ion, and calcium ion.

Hereinafter, a method for producing toner particles by the emulsion aggregation method will be exemplified and described in detail.

Dispersion Liquid Preparation Step

A binder resin particle-dispersed solution is prepared, for example, as follows. When a binder resin is a homopolymer or copolymer (vinyl resin) of a vinyl monomer, the vinyl monomer is subjected to emulsion polymerization or seed polymerization in an ionic surfactant to prepare a dispersion liquid in which vinyl resin particles are dispersed in the ionic surfactant.

When the binder resin is a resin other than a vinyl resin, such as a polyester resin, the resin is mixed in an aqueous medium in which an ionic surfactant or a polymer electrolyte is dissolved.

Thereafter, this solution is heated to the melting point or softening point of the resin to cause dissolution, and a dispersing device having a strong shearing force, such as a homogenizer, is used to prepare a dispersion liquid in which the binder resin particles are dispersed in the ionic surfactant.

The dispersing means is not particularly limited, and examples thereof include known dispersing devices such as a rotary shear type homogenizer and a ball mill, a sand mill, and a dyno mill having media.

Further, a phase inversion emulsification method may be used as a method for preparing the dispersion liquid. In the phase inversion emulsification method, a binder resin is dissolved in an organic solvent, a neutralizing agent and a dispersion stabilizer are added as necessary, an aqueous solvent is dropped under stirring to obtain emulsified particles, and the organic solvent in the resin dispersion liquid is thereafter removed to obtain an emulsion. At this time, the order of adding the neutralizing agent and the dispersion stabilizer may be changed.

The number average particle diameter of the binder resin particles is usually 1 or less, and preferably 0.01 μm to 1.00 μm. Where the number average particle diameter is 1.00 μm or less, the finally obtained toner has a suitable particle size distribution, and generation of free particles can be prevented. Further, when the number average particle diameter is within the above range, uneven distribution among the toner particles is reduced, the dispersion in the toner becomes good, and variations in performance and reliability are reduced.

In the emulsion aggregation method, a colorant particle-dispersed solution can be used as necessary. The colorant particle-dispersed solution is obtained by dispersing at least colorant particles in a dispersant. The number average particle diameter of the colorant particles is preferably 0.5 μm or less, and more preferably 0.2 μm or less. Where the number average particle diameter is 0.5 μm or less, irregular reflection of visible light can be prevented, and the binder resin particles and the colorant particles are easily aggregated in the aggregation process. Where the number average particle diameter is within the above range, uneven distribution between toners is reduced, dispersion in the toner is improved, and variations in performance and reliability are reduced.

In the emulsion aggregation method, a wax particle-dispersed solution can be used as necessary. The wax particle-dispersed solution is obtained by dispersing at least wax particles in a dispersant. The number average particle diameter of the wax particles is preferably 2.0 μm or less, and more preferably 1.0 μm or less. Where the number average particle diameter is 2.0 μm or less, the deviation in the content of wax among the toner particles is small, and the stability of the image over a long period is improved. Where the number average particle diameter is within the above range, uneven distribution between toners is reduced, dispersion in the toner is improved, and variations in performance and reliability are reduced.

The combination of the colorant particles, the binder resin particles, and the wax particles is not particularly limited and can be selected, as appropriate, depending on the purpose.

Other particle-dispersed solutions obtained by dispersing appropriately selected particles in a dispersant may be further mixed in addition to the abovementioned dispersion liquids.

The particles contained in the other particle-dispersed solutions are not particularly limited and can be selected, as appropriate, according to the purpose. Examples thereof include internal additive particles, charge control agent particles, inorganic particles, and abrasive particles. These particles may be dispersed in the binder particle-dispersed solution or the colorant particle-dispersed solution.

Examples of the dispersant contained in the binder resin particle-dispersed solution, the colorant particle-dispersed solution, the wax fine particle-dispersed solution, and the other particle-dispersed solutions include an aqueous medium including a polar surfactant. Examples of the aqueous medium include water such as distilled water and ion exchanged water, and alcohols. These may be used alone by one type and two or more types may be used in combination.

The content of the polar surfactant cannot be generally defined and can be selected, as appropriate, according to the purpose.

Examples of the polar surfactant include anionic surfactants such as sulfuric acid esters and salts, sulfonic acid salts, phosphoric acid esters, soap, and the like; cationic surfactants such as amine salts, quaternary ammonium salts, and the like; and the like.

Specific examples of the anionic surfactant include sodium dodecylbenzenesulfonate, sodium dodecyl sulfate, sodium alkylnaphthalenesulfonates, sodium dialkylsulfosuccinates and the like.

Specific examples of the cationic surfactant include alkylbenzene dimethyl ammonium chlorides, alkyl trimethyl ammonium chlorides, distearyl ammonium chloride and the like. These may be used alone by one type or two or more types may be used in combination.

These polar surfactants can be used in combination with a nonpolar surfactant. Examples of the nonpolar surfactant include nonionic surfactants based on polyethylene glycol, alkylphenol ethylene oxide adducts, and polyhydric alcohols.

The content of the colorant particles is preferably 0.1 parts by mass to 30 parts by mass with respect to 100 parts by mass of the binder resin in the aggregated particle-dispersed solution when the aggregated particles are formed.

The content of the wax particles is preferably 0.5 parts by mass to 25 parts by mass, and more preferably 5 parts by mass to 20 parts by mass with respect to 100 parts by mass of the binder resin in the aggregated particle-dispersed solution when the aggregated particles are formed.

Furthermore, in order to control the charging performance of the obtained toner more specifically, the charge control particles and the binder resin particles may be added after the aggregated particles are formed.

The particle diameter of the particles such as the binder resin particles and the colorant particles is measured using a laser diffraction/scattering particle size distribution analyzer LA-920 manufactured by Horiba, Ltd.

Aggregation Step

The aggregation step is performed for forming aggregated particles including binder resin particles and, if necessary, colorant particles, wax particles and the like in an aqueous medium including the binder resin particles and, if necessary, the colorant particles, the wax particles and the like.

The aggregated particles can be formed in an aqueous medium by, for example, adding and mixing a pH adjuster, a flocculant, and a stabilizer in the aqueous medium, and appropriately adjusting temperature, applying mechanical power, and the like.

Examples of pH adjusters include alkalis such as ammonia and sodium hydroxide, and acids such as nitric acid and citric acid. Examples of the flocculant include salts of monovalent metals such as sodium and potassium; salts of divalent metals such as calcium and magnesium; salts of trivalent metals such as iron and aluminum; and alcohols such as methanol, ethanol and propanol.

Examples of the stabilizer mainly include polar surfactants themselves or an aqueous medium including the same. For example, when the polar surfactant contained in each particle-dispersed solution is anionic, a cationic surfactant can be selected as the stabilizer.

The addition/mixing of the flocculant and the like is preferably performed at a temperature equal to or lower than the glass transition temperature of the resin contained in the aqueous medium. Where mixing is performed under such temperature conditions, aggregation proceeds in a stable state. Mixing can be performed using, for example, a known mixing device, a homogenizer, a mixer and the like.

In the aggregation step, second binder resin particles are adhered to the surface of the aggregated particles using the binder resin particle-dispersed solution including the second binder resin particles to form a coating layer (shell layer), thereby making it possible to obtain toner particles having a core/shell structure in which a shell layer is formed on the surface of the core particles.

The second binder resin particles used in this case may be the same as or different from the binder resin particles constituting the core particles. In addition, the aggregation step may be repeatedly implemented a plurality of times in a stepwise manner.

Fusion Step

The fusion step is a step in which the obtained aggregated particles are heated and fused. A pH adjuster, a polar surfactant, a nonpolar surfactant, or the like can be loaded, as appropriate, to prevent the toner particles from fusing before a transition is made to the fusion step.

The heating temperature may be from the glass transition temperature of the resin contained in the aggregated particles (the glass transition temperature of the resin having the highest glass transition temperature when there are two or more types of resin) to the decomposition temperature of the resin. Therefore, the temperature of the heating differs depending on the type of resin of the binder resin particles and cannot be generally defined, but is generally from the glass transition temperature of the resin contained in the aggregated particles to 140° C. In addition, heating can be performed using a publicly known heating device/implement.

As the fusion time, a short time is sufficient if the heating temperature is high, and a long time is necessary if the heating temperature is low. That is, the fusion time depends on the temperature of heating and cannot be defined in general, but is typically from 30 min to 10 h.

The toner particles obtained through each of the above steps can be solid-liquid separated according to a known method, and the toner particles can be recovered, and then washed, dried, etc. under appropriate conditions.

External Addition Step

A toner can be obtained by adding spherical silica particles and hydrotalcite particles to the obtained toner particles.

Binder Resin

As the binder resin, the following polymers or resins including an amorphous polyester can be used.

For example monopolymers of styrene and substituted styrene, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate ester copolymers, styrene-methacrylate ester copolymers, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenol resin, natural resin-modified phenol resin, natural resin-modified maleic acid resin, acrylic resin, methacrylic resin, polyvinyl acetate, silicone resin, polyester resin, polyurethane resin, polyamide resin, furan resin, epoxy resin, xylene resin, polyvinylbutyral, terpene resin, coumarone-indene resin and petroleum-based resin may be used.

An amorphous polyester is a resin having a "polyester structure" in a binder resin chain. Specifically, the components constituting the polyester structure include a bivalent or higher alcohol monomer component, and an acid monomer component such as a bivalent or higher carboxylic acid, a bivalent or higher carboxylic acid anhydride, a bivalent or higher carboxylic acid ester, and the like.

The following are examples of dihydric and higher alcohol monomer components: bisphenol A alkylene oxide adducts, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene (2.0)-2,2-bis(4-hydroxyphenyl)propane and polyoxypropylene(6)-2,2-bis(4-hydroxyphenyl)propane, and ethylene glycol, diethylene glycol, triethylene glycol, 1,2-propanediol, 1,3-propanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane, 1,3,5-trihydroxymethylbenzene, isosorbide and the like.

Of these, the aromatic diols can be used by preference as alcohol monomer components, and an aromatic diol is preferably included in the amount of at least 80 mol % in the alcohol monomer components constituting the polyester resin.

The following are examples of acid monomer components such as divalent and higher carboxylic acids, divalent and higher caboxylic anhydrides and divalent and higher carboxylic acid esters: aromatic dicarboxylic acids such as phthalic acid, isophthalic acid and terephthalic acid, or their anhydrides; alkyldicarboxylic acids such as succinic acid, adipic acid, sebacic acid and azelaic acid, or their anhydrides; succinic acids substituted with $C_{6-18}$ alkyl or alkenyl groups, or their anhydrides; and unsaturated dicarboxylic acids such as fumaric acid, maleic acid and citraconic acid, or their anhydrides.

Of these, acid monomer components that can be used by preference include polyvalent carboxylic acids such terephthalic acid, succinic acid, adipic acid, fumaric acid, trimellitic acid, pyromellitic acid and benzophenonetetracarboxylic acid and their anhydrides.

In addition, from the viewpoint of stability of triboelectric charge quantity, the acid value of the polyester resin is preferably from 1 mg KOH/g to 50 mg KOH/g.

The acid value can be kept within this range by adjusting the types and compounded amounts of the monomers used in the resin. Specifically, it can be controlled by adjusting the ratios and molecular weights of the alcohol monomer components and acid monomer components during resin manufacture. It can also be controlled by reacting the terminal alcohols with a polyvalent acid monomer (such as trimellitic acid) after ester condensation polymerization.

A crystalline polyester may be used as a binder resin.

Colorant

A colorant may also be contained in the toner particle. The following are examples of colorants.

Examples of black colorants include carbon black, and blacks obtained by color adjustment of blending yellow, magenta and cyan colorants. A pigment may be used alone as the colorant, but from the standpoint of image quality with full-color images, preferably a dye and a pigment are used together to improve the color clarity.

Examples of magenta pigments include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269 and 282; C.I. Pigment Violet 19; and C.I. Vat Red 1, 2, 10, 13, 15, 23, 29 and 35.

Examples of magenta dyes include C.I. Solvent Red 1, 3, 8, 23, 24, 25, 27, 30, 49, 81, 82, 83, 84, 100, 109 and 121; C.I. Disperse Red 9; C.I. Solvent Violet 8, 13, 14, 21 and 27; oil-soluble dyes such as C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39 and 40 and C.I. Basic Violet 1, 3, 7, 10, 14, 15, 21, 25, 26, 27 and 28.

Examples of cyan pigments include C.I. Pigment Blue 2, 3, 15:2, 15:3, 15:4, 16 and 17; C.I. Vat Blue 6; C.I. Acid Blue 45, and copper phthalocyanine pigments having 1 to 5 phthalimidomethyl groups substituted on a phthalocyanine skeleton.

Examples of cyan dyes include C.I. Solvent Blue 70.

Examples of yellow pigments include C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. Vat Yellow 1, 3, and 20.

Examples of yellow dyes include C.I. Solvent Yellow 162.

The content of the colorant is preferably from 0.1 to 30 mass parts per 100 mass parts of the binder resin.

Wax

A wax may also be used in the toner particle. A wax is not particularly limited, and examples of the wax include the following: hydrocarbon waxes such as low-molecular-weight polyethylene, low-molecular-weight polypropylene, alkylene copolymers, microcrystalline wax, paraffin wax and Fischer-Tropsch wax; hydrocarbon wax oxides such as polyethylene oxide wax, and block copolymers of these; waxes consisting primarily of fatty acid esters, such as carnauba wax; and partially or fully deoxidized fatty acid esters, such as deoxidized carnauba wax.

Other examples include the following: saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, seryl alcohol and melissyl alcohol; polyvalent alcohols such as sorbitol; esters of fatty acids such as palmitic acid, stearic acid, behenic acid and montanic acid with alcohols such as stearyl alcohol, aralkyl alcohol, behenyl alcohol, carnaubyl alcohol, seryl alcohol and mellisyl alcohol; fatty acid amides such as linoleamide, oleamide and lauramide; saturated fatty acid bisamides such as methylenebis stearamide, ethylenebis capramide, ethylenebis lauramide and hexamethylenebis stearamide; unsaturated fatty acid amides such as ethylenebis oleamide, hexamethylenebis oleamide, N,N'-dioleyladipamide and N,N'-dioleylsebacamide; aromatic bisamides such as m-xylenebis stearamide and N,N'-distearylisophthalamide; aliphatic metal salts (commonly called metal soaps) such as calcium stearate, calcium laurate, zinc stearate and magnesium stearate; aliphatic hydrocarbon waxes grafted with vinyl monomers such as styrene or acrylic acid; partially esterified products of fatty acids and polyvalent alcohols, such as behenic acid monoglyceride; and methyl ester compounds with hydroxyl groups obtained by hydrogenation of plant-based oils and fats.

Among these waxes, from the viewpoint of improving low-temperature fixability and resistance to wraparound in fixing, hydrocarbon waxes such as paraffin wax and Fischer-Tropsch wax are preferable.

The wax content is preferably from 0.5 parts by mass to 25 parts by mass with respect to 100 parts by mass of the binder resin.

Further, from the viewpoint of achieving both the storage stability of the toner and the high-temperature offset resistance, the peak temperature of the maximum endothermic peak present in the temperature range from 30° C. to 200° C. in the endothermic curve at the time of temperature rise measured by a differential scanning calorimeter (DSC) is preferably from 50° C. to 110° C.

Charge Control Agent

A charge control agent may be included as necessary in the toner. A known charge control agent may be used in the toner, but a metal compound of an aromatic carboxylic acid is especially desirable because it is colorless and yields a toner particle that has a rapid charging speed and can stably maintain a fixed charge quantity.

Examples of negatively-charging charge control agents include salicylic acid metal compounds, naphthoic acid metal compounds, dicarboxylic acid metal compounds, polymeric compounds having sulfonic acids or carboxylic acids in the side chains, polymeric compounds having sulfonic acid salts or sulfonic acid esters in the side chains, polymeric compounds having carboxylic acid salts or carboxylic acid esters in the side chains, and boron compounds, urea compounds, silicon compounds and calixarenes.

The charge control agent may be added either internally or externally to the toner base particle. The added amount of the charge control agent is preferably from 0.2 parts by mass to 10 parts by mass per 100 parts by mass of the binder resin.

The toner may be mixed with a magnetic carrier and used as a two-component developer to obtain stable images over a long period of time.

Examples of the magnetic carrier include well-known carriers such as magnetic bodies such as surface-oxidized iron powder, non-oxidized iron powder, metal particles such as iron, lithium, calcium, magnesium, nickel, copper, zinc, cobalt, manganese, and rare earth, alloy particles thereof, oxide particles, ferrites and the like, and magnetic body-dispersed resin carriers (the so-called resin carriers) including magnetic bodies and a binder resin holding the magnetic bodies in a dispersed state.

Hereinafter, methods for measuring each physical property value according to the present invention will be described.

Method for Measuring Number Average Particle Diameters (Da, Db) of Spherical Silica Particles and Hydrotalcite Particles The number average particle diameters (Da, Db) of spherical silica particles and hydrotalcite particles are measured as follows.

An image of a toner particle surface is captured at a magnification of 100,000 times with FE-SEM S-4800 (manufactured by Hitachi, Ltd.). Using the enlarged image, the particle diameters of 100 or more spherical silica particles and hydrotalcite particles are measured, and the number average particle diameters (Da, Db) of the spherical silica particles and hydrotalcite particles are determined by arithmetic averaging.

The particle diameter is counted as an absolute maximum length when the shape is spherical, and as a major axis when the particle has a major axis and a minor axis. Whether or not the silica particles are spherical can be determined by measurement according to the measurement of circularity described later.

Further, the hydrotalcite particles on the toner particle surface can be distinguished by the following method.

Identification Method of Hydrotalcite Particles

Hydrotalcite particles can be identified by combining shape observation with a scanning electron microscope (SEM) and elemental analysis with energy dispersive X-ray analysis (EDS).

Using S-4800, focus is adjusted on the toner particle surface and the external additive to be discriminated is observed. By performing EDS analysis of the external additive to be discriminated, hydrotalcite particles can be identified from the presence or absence of an element peak.

When an element peak of at least one metal selected from the group consisting of Mg, Zn, Ca, Ba, Ni, Sr, Cu, and Fe and an element peak of at least one metal selected from the group consisting of Al, B, Ga, Fe, Co, and In, which are metals that can constitute a hydrotalcite particle, are observed as the element peaks, the presence of a hydrotalcite particle including metals of the two kinds can be estimated.

A sample of hydrotalcite particles estimated by the EDS analysis is prepared separately, and shape observation by SEM and EDS analysis are performed. Whether or not the analysis result of the specimen matches the analysis result of the particle to be discriminated is determined by comparison, and whether or not the particle is a hydrotalcite particle is determined.

In addition, when spherical silica particles or hydrotalcite particles before external addition are available, the number average particle diameter can be calculated by the above-mentioned method by using the particles.

Method for Measuring Circularity of Spherical Silica Particles

To measure the circularity of the spherical particles, calculation is performed by using image analysis software ImageJ (developed by Wayne Rashand) to analyze a toner surface observation image captured with Hitachi Ultra High Resolution Field Emission Scanning Electron Microscope S-4800 (Hitachi High-Technologies Corporation). The measurement procedure is shown below.

(1) Sample Preparation

A thin layer of conductive paste is applied to a sample table (aluminum sample table 15 mm×6 mm), and a toner is deposited thereon. Using a blower, the excess toner is air blown followed by sufficient drying. The sample stage is set on the sample holder.

(2) S-4800 Observation Conditions

Observation conditions are shown below.

Acceleration voltage: 0.8 kV
Emission current: 20 μA
Detector: [on SE (U)], [+BSE (L.A.100)]
Probe current: [Normal]
Focus mode: [UHR]
WD: [3.0 mm]

(3) Image Storage

Brightness is adjusted in an ABC mode, and an image is captured with a size of 640×480 pixels and saved. The following analysis is performed using this image file. At this time, a relatively flat portion of the toner surface (a visual field in which the entire observation surface is in focus) is selected to obtain an image. The observation magnification is appropriately adjusted according to the size of the fine particle that is the observation target.

(4) Image Analysis

From the obtained SEM observation image, the circularity is calculated using image processing software ImageJ (developer Wayne Rashand). The calculation procedure is shown below.

[1] A scale is set with [Analyze]-[Set Scale].

[2] A threshold is set with [Image]-[Adjust]-[Threshold]. (Setting to a value at which noise does not remain and the inorganic fine particle to be measured remains.)

[3] In [Image]-[Crop], the measured image portion of the inorganic fine particles is selected.

[4] The overlapping particles are erased by image editing.

[5] The monochrome image is inverted with [Edit]-[Invert].

[6] [Area] and [Shape Descriptors] are checked with [Analyze]-[Set Measurements]. Also,

[Redirect to] is set to [None], and

[Decimal Place (0-9)] is set to 3.

[7] The area of the particle is indicated to be 0.0003 $\mu m^2$ or more and analysis is performed with [Analyze]-[Analyze Particle].

[8] The value of circularity of each particle is obtained.

[9] Measurement is performed on 100 or more particles observed, and an arithmetic average value of the obtained circularity is calculated to obtain circularity.

The measurement can be performed in the same manner for a toner in which a plurality of types of fine particles is contained on the toner particle surface. When the reflected electron image is observed in S-4800, the elements of each fine particle can be specified using elemental analysis such as EDAX. Further, it is possible to select fine particles of the same kind from the shape characteristics and the like. By performing the above measurement on fine particles of the same kind, the circularity of fine particles for each kind can be calculated. Similarly, the above-described measurement of the number average particle diameter (Da, Db) can be performed for fine particles of each kind.

Where the spherical silica particles before external addition are available, the circularity can also be calculated by the above method by using such particles.

Method for Measuring Weight Average Particle Diameter (D4) of Toner

The weight average particle diameter (D4) of the toner is calculated as follows. As a measuring device, a precision particle size distribution measuring device "Coulter Counter Multisizer 3" (registered trademark, manufactured by Beckman Coulter, Inc.) using a pore electrical resistance method and equipped with a 100 μm aperture tube is used. For setting the measurement conditions and analyzing the measurement data, the dedicated software "Beckman Coulter Multisizer 3 Version 3.51" (manufactured by Beckman Coulter, Inc.) provided with the device is used.

The measurement is performed with 25,000 effective measurement channels. As the electrolytic aqueous solution used for the measurement, a solution obtained by dissolving special grade sodium chloride in ion-exchanged water to a concentration of about 1% by mass, for example, "ISOTON II" (manufactured by Beckman Coulter, Inc.), can be used.

Measurement of Fixing Ratio of Spherical Silica Particles

Washing Step

In a 50 mL vial, 20 g of 30% by mass aqueous solution of "CONTAMINON N" (neutral detergent for washing precision measuring instruments that has pH 7 and consists of a nonionic surfactant, an anionic surfactant and an organic builder) is weighed and mixed with 1 g of toner.

The mixture is set to "KM Shaker" (model: V. SX) manufactured by Iwaki Sangyo Co., Ltd., and shaking is performed for 120 sec at a set speed of 50. As a result, depending on the fixed state of the spherical silica particles, the spherical silica particles move from the toner particle surface into the dispersion liquid.

Thereafter, the toner and the spherical silica particles transferred to the supernatant liquid are separated with a centrifuge (H-9R; manufactured by Kokusan Co., Ltd.) (for 5 min at 16.67 $S^{-1}$).

The precipitated toner is dried by vacuum drying (40° C./24 h) and washed with water to obtain a toner.

Next, the image of the toner obtained through the water washing step (toner after water washing) is captured using Hitachi Ultra High Resolution Field Emission Scanning Electron Microscope S-4800 (Hitachi High-Technologies Corporation).

Then, the captured toner surface image is analyzed with image analysis software Image-Pro Plus ver. 5.0 (Nippon Roper Co., Ltd.), and the fixing ratio is calculated.

The image capturing conditions for S-4800 are as follows.

(1) Sample Preparation

A thin layer of conductive paste is applied to a sample table (aluminum sample table 15 mm×6 mm), and the toner is deposited thereon. Using a blower, the excess toner is air blown followed by sufficient drying. The sample stage is set on the sample holder, and the height of the sample stage is adjusted to 36 mm with a sample height gauge.

(2) S-4800 Observation Condition Setting

In the measurement of the fixing ratio, the elemental analysis by the energy dispersive X-ray analysis (EDS) described above is performed in advance, and the measurement is performed after distinguishing the spherical silica particles on the toner particle surface.

Liquid nitrogen is poured until overflowing into an anti-contamination trap attached to the case of the S-4800, and left for 30 minutes. The "PC-SEM" of the S-4800 is operated to perform flushing (purification of FE chip electron source). The acceleration voltage display part of the control panel on the image is clicked, and the "flushing" button is pressed to open a flushing execution dialog. This is executed after the flushing strength is confirmed to be 2. The emission current from flushing is then confirmed to be 20 μA to 40 μA. The sample holder is inserted into the sample chamber of the S-4800 case. "Origin" is pressed on the control panel to transfer the sample holder to the observation position.

The acceleration voltage display part is clicked to open an HV setting dialog, and the acceleration voltage is set to "1.1 kV" and the emission current to "20 μA". In the "basic" tab of the operation panel, the signal selection is set to "SE", "upper (U)" with "+BSE" is selected as the SE detector, and "L.A. 100" is selected with the selection button to the right of "+BSE" to set the backscattered electron imaging mode. In the same "basic" tab of the operation panel, the probe current of the electronic optical system condition block is set to "Normal", the focus mode to "UHR", and WD to "4.5 mm". The "On" button of the acceleration voltage display part on the control panel is pressed to apply acceleration voltage.

(3) Calculation of Number Average Particle Diameter (D1) of Toner

The magnification is set to 5000-fold (5 k-fold) by dragging in the magnification display part of the control panel. The focus knob [COARSE] on the operation panel is rotated, and the aperture alignment is adjusted when the focus is achieved to some extent. [Align] on the control panel is clicked to display an alignment dialog, and [Beam] is selected. The STIGMA/ALIGNMENT knobs (X, Y) on the operation panel are rotated to move the displayed beam to the center of the concentric circle. Next, [Aperture] is selected, and the STIGMA/ALIGNMENT knobs (X, Y) are turned one by one to stop the movement of the image or adjust the movement to the minimum. The aperture dialog is closed and focusing is performed with auto focus. The operation is repeated two more times to focus.

Thereafter, the particle diameter of 300 toner particles is measured to determine the number average particle diameter (D1). The particle diameter of each particle is the maximum diameter when the toner particles are observed.

(4) Focus Adjustment

For the particles with a diameter within ±0.1 μm of the number average particle diameter (D1) obtained in (3), the magnification is set to 10000 (10 k) times by dragging in the magnification display part of the control panel in a state where the midpoint of the maximum diameter is aligned with the center of the measurement screen.

The focus knob [COARSE] on the operation panel is rotated, and the aperture alignment is adjusted when the focus is achieved to some extent. [Align] on the control panel is clicked to display an alignment dialog, and [Beam] is selected. The STIGMA/ALIGNMENT knobs (X, Y) on the operation panel are rotated to move the displayed beam to the center of the concentric circle.

Next, [Aperture] is selected, and the STIGMA/ALIGNMENT knobs (X, Y) are turned one by one to stop the movement of the image or adjust the movement to the minimum. The aperture dialog is closed and focusing is performed with auto focus.

After that, the magnification is set to 50000-fold (50 k-fold), the focus is adjusted using the focus knob and STIGMA/ALIGNMENT knob in the same manner as described above, and the focus is again adjusted by autofocus. This operation is repeated again to focus. Here, since the measurement accuracy of the coverage rate tends to be low when the angle of inclination of the observation surface is large, a mode is selected in which focusing is performed simultaneously on the entire observation surface when adjusting the focus, thereby performing analysis by selecting the smallest possible surface inclination.

(5) Image Storage

Brightness is adjusted in an ABC mode, and an image is captured with a size of 640×480 pixels and saved. The following analysis is performed using this image file. One image is captured for one toner particle, and an image is obtained for 25 toner particles.

(6) Image Analysis

The fixing ratio is calculated by binarizing the image obtained by the above-described method by using the following analysis software. At this time, analysis is performed by dividing one screen into 12 squares.

The analysis conditions of image analysis software Image-Pro Plus ver. 5.0 are as follows. However, when the number average particle diameter of the added external additive is unknown, the measurement object is excluded according to the particle diameter as described below. When silica particles with a particle diameter of less than 10 nm and spherical silica particles with a particle diameter of more than 40 nm are contained in the divided section, the fixing ratio is not calculated in this section.

"Count"/"Size" and "Options" are successively selected from "Measure" in the toolbar, and the binarization condition is set. Among Segmentation Options, 8-connected is selected and smoothing is set to 0. In addition, sorting, filling holes, and inclusion lines are not selected, and "Clean Borders" is set to "None". "Measurements" is selected from "Measure" on the tool bar, and 2 to $10^7$ is inputted as the ranges of Area in Filter Ranges.

The fixing ratio is calculated by enclosing a square region. At this time, the area (C) of the region is set to be 24000 pixels to 26000 pixels. In the "Processing"-Binarization, automatic binarization is performed, and the total area (D) of the region without spherical silica particles is calculated.

From the area C of the square region and the total area D of the region without the spherical silica particles, the fixing ratio is obtained by the following formula.

Region where spherical silica particles are present (%)=100−(D/C×100)

By performing the above analysis with the toner before and after washing with water, the fixing ratio of the spherical silica particles can be obtained from the following formula.

Fixing ratio (%)=(region where spherical silica particles are present in the toner after washing/region where spherical silica particles are present in the toner before washing)×100

The arithmetic average value of all obtained data is taken as the fixing ratio.

Measurement of Fixing Ratio of Hydrotalcite Particles

The fixing ratio of the hydrotalcite particles is measured after the hydrotalcite particles are identified as described in Method for Measuring Number Average Particle Diameters (Da, Db) of Spherical Silica Particles and Hydrotalcite Particles.

First, sample preparation is performed as follows.

Toner before washing with water: the toner to be measured is used as it is.

Toner after washing with water: 160 g of sucrose (manufactured by Kishida Chemical Co., Ltd.) is added to 100 mL of ion exchanged water and dissolved by heating with a water bath to prepare a sucrose concentrate. Then, 31 g of the sucrose concentrate and 6 mL of CONTAMINON N (10% by mass aqueous solution of neutral detergent for washing precision measuring instruments that includes a nonionic surfactant, an anionic surfactant and an organic builder and has a pH of 7; manufactured by Wako Pure Chemical Industries, Ltd.) are placed in a centrifuge tube to prepare a dispersion liquid. A total of 1 g of the toner is added to the dispersion liquid and lumps of the toner are loosened with a spatula or the like.

The centrifuge tube is set to "KM Shaker" (model: V. SX) manufactured by Iwaki Sangyo Co., Ltd., and shaking is performed for 120 sec at a set speed of 50. After shaking, the solution is transferred to a glass tube for swing rotor (50 mL), and the toner and the external additive transferred to the supernatant liquid are separated with a centrifuge (H-9R; manufactured by Kokusan Co., Ltd.) (for 5 min at 16.67 $S^{-1}$).

After visual confirmation that the toner and the aqueous solution have been sufficiently separated, the toner separated in the uppermost layer is collected with a spatula or the like. The aqueous solution including the collected toner is filtered with a vacuum filter and then dried with a dryer for 1 h or more to prepare a sample.

For these samples before and after washing, the fixing ratio is determined by using the intensity of the target element by wavelength dispersive X-ray fluorescence analysis (XRF).

About 1 g of the toner after water washing or the toner before water washing are put into a dedicated aluminum ring for pressing and leveled, pressurization is performed for 60 sec at 20 MPa by using a tablet-forming compressor "BRE-32" (Maekawa Test Instruments Co., Ltd.) to obtain pellets molded to a thickness of about 2 mm and the pellets are used as a measurement sample.

A wavelength dispersion type fluorescent X-ray analyzer "Axios" (manufactured by PANalytical) and dedicated software "SuperQ ver. 4.0F" (manufactured by PANalytical) provided therewith for setting measurement conditions and analyzing measurement data are used as a measuring device. Rh is used as the anode of the X-ray tube, the measurement atmosphere is vacuum, the measurement diameter (collimator mask diameter) is 10 mm, and the measurement time is 10 sec. Further, when measuring a light element, a proportional counter (PC) is used for detection, and when measuring a heavy element, a scintillation counter (SC) is used. The measurement is performed under the above conditions, the elements are identified based on the obtained X-ray peak positions, and the concentration thereof is calculated from the count rate (unit: cps) which is the number of X-ray photons per unit time.

As for the fixing ratio from the toner, first, the element intensity of the toner before washing and the toner after washing is obtained by the above method. Thereafter, the fixing ratio is calculated based on the following formula.

As an example, the formula where Mg is used as the target element in the hydrotalcite particles is shown.

Fixing ratio of hydrotalcite particles (*Kb*)=(intensity of Mg element of toner after washing)/(intensity of Mg element of toner before washing)×100 [Formula]

Measurement of Content of Spherical Silica Particles and Hydrotalcite Particles

The content of the spherical silica particles and the hydrotalcite particles is obtained by calculation from the intensity of the metallic elements derived from the spherical silica particles and the hydrotalcite particles in the toner measured with an X-ray fluorescence analyzer (XRF).

For example, in the following Examples, the content of spherical silica particles and the content of hydrotalcite particles can be analyzed and calculated using a calibration curve method from the Si element intensity and Mg element intensity, respectively.

EXAMPLES

Hereinafter, the present invention will be specifically described with reference to examples and comparative examples, but the present invention is not limited to these examples. In the examples and comparative examples, all "parts" are based on mass unless otherwise specified.

Production Example of Spherical Silica Particles 1

A total of 500 parts of methanol and 70 parts of water adjusted to pH 5.4 using 10% by mass hydrochloric acid were added and mixed in a 1.5 L glass reaction vessel equipped with a stirrer, a dropping nozzle, and a thermometer to obtain a catalyst solution. After the catalyst solution was adjusted to 30° C., 100 parts of tetramethoxysilane (TMOS) and 20 parts of 8.0% by mass ammonia water were dropped simultaneously over 60 min while stirring to obtain a hydrophilic silica fine particle-dispersed solution.

Thereafter, the obtained silica particle-dispersed solution was concentrated to a solid fraction concentration of 40% by mass with a rotary filter R-Fine (manufactured by Kotobuki Industries Co., Ltd.) to obtain a silica particle-dispersed solution.

A total of 50 parts of hexamethyldisilazane (HMDS) as a hydrophobizing agent was added to 250 parts of the silica particle-dispersed solution, a reaction was conducted at 130° C. for 2 h, and the reaction product was cooled and dried by spray drying to obtain spherical silica particles 1. Table 1 shows the physical properties of the spherical silica particles 1 obtained.

Production of Spherical Silica Particles 2 to 4 and Comparative Particles 1 and 2

Spherical silica fine particles 2 to 4 and comparative particles 1 and 2 were produced in the same manner as the spherical silica fine particles 1 except that some of the production conditions of the spherical silica fine particles 1 were changed to the reaction conditions shown in Table 1. Table 1 shows the physical properties.

Comparative Particles 3

"NX-90G" manufactured by Nippon Aerosil Co., Ltd. was used as the comparative particles 3. Table 1 shows the physical properties.

TABLE 1

| | | Reaction conditions | | Physical properties | |
|---|---|---|---|---|---|
| Particles | Type | Temperature | Dropping time | Number average particle diameter Da (nm) | Circularity |
| Spherical silica particles 1 | Sol-gel silica | 30° C. | 60 min | 30 | 0.90 |
| Spherical silica particles 2 | Sol-gel silica | 30° C. | 30 min | 12 | 0.88 |
| Spherical silica particles 3 | Sol-gel silica | 40° C. | 50 min | 38 | 0.93 |
| Spherical silica particles 4 | Sol-gel silica | 30° C. | 50 min | 28 | 0.82 |
| Spherical silica particles 5 | Sol-gel silica | 30° C. | 80 min | 33 | 0.95 |
| Comparative particles 1 | Sol-gel silica | 25° C. | 25 min | 8 | 0.85 |
| Comparative particles 2 | Sol-gel silica | 45° C. | 80 min | 45 | 0.92 |
| Comparative particles 3 | Fumed silica | — | — | 20 | 0.75 |

Production Example of Hydrotalcite Particles 1

A total of 203.3 g of magnesium chloride hexahydrate and 96.6 g of aluminum chloride hexahydrate were dissolved in 1 L of deionized water, and the pH of the solution was adjusted to 10.5, while maintaining the temperature at 25° C., with a solution obtained by dissolving 60 g of sodium hydroxide in 1 L of deionized water. The solution was then matured at 98° C. for 24 h.

After cooling, the precipitate was washed with deionized water until the electric conductivity of the filtrate reached 100 μS/cm or less to obtain a slurry having a concentration of 5% by mass. Spray drying was performed with a spray dryer (DL-41, manufactured by Yamato Scientific Co., Ltd.) at a drying temperature of 180° C., a spraying pressure of 0.16 MPa, and a spraying rate of about 150 mL/min, while stirring this slurry, to obtain hydrotalcite particles 1. Table 2 shows the physical properties of the hydrotalcite particles 1 obtained.

Production Example of Hydrotalcite Particles 2 to 5

Hydrotalcite particles 2 to 5 were prepared in the same manner as hydrotalcite particles 1 by appropriately adjusting the amount of raw materials and reaction conditions. Table 2 shows the physical properties.

TABLE 2

| Particles | Type | Number average particle diameter Db (nm) |
|---|---|---|
| Hydrotalcite particles 1 | Hydrotalcite | 280 |
| Hydrotalcite particles 2 | Hydrotalcite | 320 |
| Hydrotalcite particles 3 | Hydrotalcite | 225 |
| Hydrotalcite particles 4 | Hydrotalcite | 200 |
| Hydrotalcite particles 5 | Hydrotalcite | 400 |

Production Example of Polyester Resin 1

In a reactor equipped with a stirrer, a thermometer, and a cooler for outflow, 20 parts of propylene oxide-modified bisphenol A (2 mol adduct), 80 parts of propylene oxide-modified bisphenol A (3 mol adduct), 20 parts of terephthalic acid, 20 parts of isophthalic acid and 0.50 part of tetrabutoxytitanium were added and an esterification reaction was performed at 190° C.

Thereafter, 1 part of trimellitic anhydride (TMA) was added, the temperature was raised to 220° C., the pressure inside the system was gradually reduced, and a polycondensation reaction was performed at 150 Pa to obtain a polyester resin 1. The acid value of the polyester resin 1 was 12 mg KOH/g, and the softening point was 110° C.

Preparation of Polyester Resin Particle-Dispersed Solution

| | |
|---|---|
| Polyester resin 1 | 200 parts |
| Ion exchanged water | 500 parts |

The above materials were put in a stainless steel container, heated to 95° C. in a hot bath and melted, and 0.1 mol/L sodium bicarbonate was added, while thoroughly stirring at 7800 rpm using a homogenizer (manufactured by IKA: Ultra Turrax T50), to increase pH above 7.0. Thereafter, a mixed solution of 3 parts of sodium dodecylbenzenesulfonate and 297 parts of ion exchanged water was gradually added dropwise, and emulsification and dispersion were performed to obtain polyester resin particle-dispersed solution 1.

When the particle size distribution of this polyester resin particle-dispersed solution 1 was measured using a particle size measuring device (LA-920, manufactured by Horiba, Ltd.), the number average particle diameter of the contained polyester resin particles was 0.25 μm. In addition, coarse particles exceeding 1 μm were not observed.

Preparation of Wax Particle-Dispersed Solution

| | |
|---|---|
| Ion exchanged water | 500 parts |
| Wax (hydrocarbon wax; endothermic peak maximum temperature 77° C.) | 250 parts |

The above materials were put in a stainless steel container, heated to 95° C. in a hot bath and melted, and 0.1 mol/L sodium bicarbonate was added, while thoroughly stirring at 7800 rpm using a homogenizer (manufactured by IKA: Ultra Turrax T50), to increase pH above 7.0.

Thereafter, a mixed solution of 5 parts of sodium dodecylbenzenesulfonate and 245 parts of ion exchanged water was gradually added dropwise, and emulsification and dispersion were performed. When the particle size distribution of wax particles contained in the wax particle-dispersed solution was measured using a particle size measuring device (LA-920, manufactured by Horiba, Ltd.), the number average particle diameter of the contained wax particles was 0.35 μm. In addition, coarse particles exceeding 1 μm were not observed.

Preparation of Colorant Particle-Dispersed Solution 1

| | |
|---|---|
| C.I. Pigment Blue 15:3 | 100 parts |
| Sodium dodecylbenzenesulfonate | 5 parts |
| Ion exchanged water | 400 parts |

The above materials were mixed and dispersed using a sand grinder mill. When the particle size distribution of colorant particles contained in the colorant particle-dispersed solution was measured using a particle size measuring device (LA-920, manufactured by Horiba, Ltd.), the number average particle diameter of the contained colorant particles was 0.2 μm. In addition, coarse particles exceeding 1 μm were not observed.

Production Example of Toner Particles 1

| | |
|---|---|
| Polyester resin particle-dispersed solution 1 | 500 parts |
| Colorant particle-dispersed solution 1 | 50 parts |
| Wax particle-dispersed solution | 50 parts |
| Sodium dodecylbenzenesulfonate | 5 parts |

The polyester resin particle-dispersed solution 1, the wax particle-dispersed solution, and sodium dodecylbenzenesulfonate were charged into a reactor (flask with a capacity of 1 L, baffle-attached anchor blades) and mixed uniformly. Meanwhile, the colorant particle-dispersed solution 1 was uniformly mixed in a 500 mL beaker, and this mixture was gradually added to the reactor while stirring to obtain a mixed dispersion liquid. A total of 0.5 parts of an aqueous aluminum sulfate solution as a solid content was dropped, while stirring the obtained mixed dispersion liquid, to form aggregated particles.

After completion of the dropping, the system was purged with nitrogen, and held at 50° C. for 1 h and further at 55° C. for 1 h.

The temperature was then raised and held at 90° C. for 30 min. Thereafter, the temperature was lowered to 63° C. and held for 3 h to form fused particles. The reaction at this time was performed in a nitrogen atmosphere. After a predetermined time, cooling was performed at a rate of 0.5° C. per minute until the temperature reached room temperature.

After cooling, the reaction product was subjected to solid-liquid separation under a pressure of 0.4 MPa with a pressure filter having a capacity of 10 L to obtain a toner cake. Thereafter, ion exchanged water was added to fill the pressure filter with water, and washing was performed at a pressure of 0.4 MPa. Further, the same washing was carried out for a total of 3 times. Thereafter, solid-liquid separation was performed under a pressure of 0.4 MPa, and fluidized bed drying was performed at 45° C. to obtain toner particles 1. Table 3 shows the physical properties of toner particles 1 thus obtained.

Production Example of Toner Particles 2

| | |
|---|---|
| Polyester resin A (polycondensate of terephthalic acid:isophthalic acid:propylene oxide-modified bisphenol A (2 mol adduct):ethylene oxide-modified bisphenol A (2 mol adduct) = 20:20:44:50 (mass ratio); Mw = 7000, Mn = 3200, Tg = 57° C.) | 45.0 parts |
| Polyester resin B (polycondensate of terephthalic acid:trimellitic acid:propylene oxide-modified bisphenol A (2 mol adduct):ethylene oxide-modified bisphenol A (2 mol adduct) = 24:3:70:2 (mass ratio); Mw = 11,000, Mn = 4200, Tg = 52° C.) | 40.0 parts |
| Methyl ethyl ketone | 80.0 parts |
| Ethyl acetate | 80.0 parts |
| Hydrocarbon wax (Fischer-Tropsch wax, maximum endothermic peak = 78° C. Mw = 750) | 7.0 parts |
| C.I. Pigment Blue 15:3 | 6.0 parts |
| Charge control resin (poly 2,4-dihydroxybenzoic acid) | 1.9 parts |
| Surfactant (polyoxyethylene alkyl ether) | 0.085 parts |

(0.10 parts per 100 parts in total of polyester resins A and B)

The above materials were dispersed for 3 h using an attritor (manufactured by Mitsui Kinzoku Co., Ltd.) and allowed to stand for 72 h to obtain a mixed colorant-dispersed solution.

Meanwhile, after adding 17 parts of sodium phosphate to 220 parts of ion exchanged water and heating to 60° C., 20 parts of 1.0 mol/L-$CaCl_2$ aqueous solution was gradually added to obtain an aqueous medium including a calcium phosphate compound.

The colorant-dispersed solution was loaded into the aqueous medium, and stirred at 12000 rpm for 15 min with a TK homomixer at a temperature of 65° C. in an $N_2$ atmosphere to granulate the colorant-dispersed solution. Thereafter, the TK homomixer was changed to a normal propeller stirring device, the rotation speed of the stirring device was maintained at 150 rpm, the internal temperature was raised to 95° C. and held for 3 h to remove the solvent, and an aqueous medium in which resin particles were dispersed was obtained.

Hydrochloric acid was added to the aqueous medium in which resin particles were dispersed to adjust the pH to 1.4, and calcium phosphate was dissolved by stirring for 1 h. The dispersion liquid was filtered with a pressure filter, and the resulting wet toner particles were washed to obtain a toner cake. Thereafter, the toner cake was crushed and dried to obtain toner particles 2. Table 3 shows the physical properties of toner particles 2 obtained.

TABLE 3

| Particle | Weight-average particle diameter D4 (μm) | Production method |
|---|---|---|
| Toner particle 1 | 6.0 | Emulsion aggregation |
| Toner particle 2 | 6.0 | Dissolution suspension |

Production Example of Toner 1

Spherical silica particles 1 (1.0 parts) and hydrotalcite particles 1 (0.5 parts) were externally added to the obtained toner particles 1 (100 parts), and mixed with FM10C (manufactured by Nippon Coke Industries, Ltd.). The external addition conditions were as follows: toner particle load amount: 2.0 kg, rotation speed: 66.6 $s^{-1}$, external addition time: 10 min, and cooling water at a temperature of 22° C. and a flow rate of 11 L/min.

Thereafter, the mixture was sieved with a mesh having an opening of 200 to obtain toner 1. Table 4 shows the physical properties of toner 1 thus obtained.

Production Examples of Toners 2 to 26

Toners 2 to 26 were obtained in the same manner as in the production example of toner 1, except that the types and addition amounts of silica particles and hydrotalcite particles used were changed as described in Table 4. Table 4 shows the physical properties of toners 2 to 26 obtained. For toners 18 and 19, the rotation speed of 66.6 $s^{-1}$ and the external addition time of 10 min of the external addition conditions were changed to the rotation speed of 60 $s^{-1}$ and the external addition time of 8 min. Table 4 shows the physical properties.

TABLE 4

| | | Silica particles | | Hydrotalcite particles | | | | | |
|---|---|---|---|---|---|---|---|---|---|
| Toner No. | Toner particle No. | Type | Amount added (parts) | No. | Amount added (parts) | Fixing ratio Ka (%) | Fixing ratio Kb (%) | Db/Da ratio | Value of formula (1) |
| 1 | 1 | Spherical silica particles 1 | 1.00 | 1 | 0.50 | 80 | 60 | 9.3 | 1.000 |
| 2 | 1 | Spherical silica particles 2 | 1.00 | 1 | 0.50 | 90 | 58 | 23.3 | 0.476 |
| 3 | 1 | Spherical silica particles 3 | 1.00 | 2 | 0.50 | 70 | 61 | 8.4 | 1.538 |
| 4 | 1 | Spherical silica particles 4 | 1.00 | 1 | 0.50 | 82 | 59 | 10.0 | 0.878 |
| 5 | 1 | Spherical silica particles 5 | 1.00 | 1 | 0.50 | 78 | 61 | 8.5 | 1.128 |
| 6 | 1 | Spherical silica particles 1 | 0.10 | 1 | 1.00 | 72 | 45 | 9.3 | 0.051 |
| 7 | 2 | Spherical silica particles 1 | 1.00 | 1 | 0.50 | 80 | 60 | 9.3 | 1.000 |
| 8 | 1 | Spherical silica particles 1 | 1.00 | 3 | 0.50 | 78 | 62 | 7.5 | 1.158 |
| 9 | 1 | Spherical silica particles 1 | 1.00 | 4 | 0.50 | 77 | 63 | 6.7 | 1.243 |
| 10 | 1 | Spherical silica particles 1 | 0.20 | 1 | 0.06 | 93 | 68 | 9.3 | 0.729 |
| 11 | 1 | Spherical silica particles 1 | 0.20 | 1 | 0.04 | 91 | 71 | 9.3 | 1.552 |
| 12 | 1 | Spherical silica particles 1 | 1.00 | 1 | 1.50 | 81 | 30 | 9.3 | 0.181 |
| 13 | 1 | Spherical silica particles 1 | 1.50 | 1 | 0.50 | 70 | 53 | 9.3 | 1.915 |
| 14 | 1 | Spherical silica particles 1 | 0.08 | 1 | 0.22 | 94 | 62 | 9.3 | 0.057 |
| 15 | 1 | Spherical silica particles 1 | 5.50 | 1 | 0.50 | 72 | 45 | 9.3 | 5.600 |
| 16 | 1 | Spherical silica particles 1 | 1.00 | 1 | 1.00 | 84 | 15 | 9.3 | 0.188 |
| 17 | 1 | Spherical silica particles 1 | 1.00 | 5 | 1.00 | 86 | 11 | 13.3 | 0.157 |
| 18 | 1 | Spherical silica particles 1 | 1.00 | 1 | 0.50 | 60 | 55 | 9.3 | 1.778 |
| 19 | 1 | Spherical silica particles 1 | 3.00 | 1 | 0.50 | 50 | 60 | 9.3 | 7.500 |
| 20 | 1 | Spherical silica particles 2 | 0.50 | 1 | 0.10 | 98 | 58 | 23.3 | 0.238 |
| 21 | 1 | Spherical silica particles 1 | 3.00 | 1 | 0.35 | 77 | 67 | 9.3 | 5.974 |
| 22 | 1 | Spherical silica particles 1 | 3.20 | 1 | 0.35 | 77 | 66 | 9.3 | 6.185 |
| 23 | 1 | Comparative particles 1 | 1.00 | 1 | 0.50 | 86 | 60 | 35.0 | 0.700 |
| 24 | 1 | Comparative particles 2 | 1.00 | 1 | 0.50 | 72 | 60 | 6.2 | 1.400 |
| 25 | 1 | Comparative particles 3 | 1.00 | 1 | 0.50 | 80 | 60 | 14.0 | 1.000 |
| 26 | 1 | Spherical silica particles 1 | 0.12 | 1 | 0.22 | 95 | 40 | 9.3 | 0.045 |

Example 1

Toner 1 was evaluated for the following items.

Evaluation Apparatus

A color laser beam printer (HP LaserJet Enterprise Color M652n) manufactured by Hewlett-Packard was used as an image forming apparatus, and the apparatus was modified to obtain a process speed of 300 mm/sec. An HP 656X genuine LaserJet toner cartridge (cyan) was used as the cartridge. The production toner was extracted from the inside of the cartridge, the cartridge was cleaned by air blow, and 300 g of toner 1 was then loaded therein. The toner was evaluated by performing the following durability test by using the cartridge.

Fusion on Developing Blade

In a low-temperature and low-humidity environment (15° C./10% RH), an endurance test was performed by outputting 30000 prints of images with a print percentage of 1.0% with an intermittent time of 2 sec every 2 prints. A solid image and a halftone image (toner laid-on level 0.25 mg/$cm^2$) were outputted one by one as evaluation images for every 1000 prints. Further, after 30000 prints, the cartridge was taken out from the printer main body, and the fused material on the developing blade was observed visually and with a microscope. As the microscope, an ultra-deep shape measuring microscope (manufactured by Keyence Corporation) was used.

Evaluation was performed based on the following criteria from the evaluation image and the result of visual/microscopic observations. It is known that in the present endurance test, the hydrotalcite particles detached from the toner form aggregates or the like together with the spherical silica particles, and the aggregates grow along with the endurance use, thereby lowering the evaluation result. C or higher was determined as good.

A: there is no problem on the image, and no fused material is observed by microscopic observation.

B: there is no problem in the image, and a very small amount of fused material is observed by microscopic observation.

C: three or more vertical streaks with low density are seen in the halftone image.

D: three or more white vertical streaks are seen in the solid image.

Initial Fogging and Fogging After Storage

Evaluation was performed under a high-temperature and high-humidity environment (30° C./80% RH). First, an image having a white background portion was outputted in the initial stage of durability, the fogging density (%) was calculated from the difference between the whiteness of the white background portion of the output image measured with "REFLECTMETER MODEL TC-6DS" (manufactured by Tokyo Denshoku Co., Ltd.) and the whiteness of evaluation paper (%), and initial fogging was evaluated. An amberlite filter was used as the filter.

Thereafter, an endurance test was performed by outputting 30000 prints of images with a print percentage of 1.0% with an intermittent time of 2 sec every 2 prints. After outputting 30000 images, the machine was turned off and the developing device was allowed to stand in the machine for 72 h under the same environment. Thereafter, the machine was turned on again, the fogging density (%) was calculated in the same way as in the initial stage, and the fogging after storage evaluated. An amberlite filter was used as the filter. Evaluation criteria were set as follows. C or higher was determined as good.

A: less than 2.0
B: 2.0 or more and less than 3.0
C: 3.0 or more and less than 4.0
D: 4.0 or more Examples 2 to 22, Comparative Examples 1 to 4

Toners 2 to 26 were evaluated by the above evaluation method. The evaluation results are shown in Table 5.

TABLE 5

| | | Developing | Initial fogging | | Fogging after storage | |
|---|---|---|---|---|---|---|
| | Toner No. | blade fusion Rank | Rank | Fogging density | Rank | Fogging density |
| Example 1 | 1 | A | A | 0.3 | A | 1.4 |
| Example 2 | 2 | B | A | 0.5 | A | 1.6 |
| Example 3 | 3 | B | A | 0.4 | A | 1.7 |
| Example 4 | 4 | C | A | 0.6 | B | 2.1 |
| Example 5 | 5 | A | A | 0.3 | A | 1.3 |
| Example 6 | 6 | C | A | 0.2 | B | 2.5 |
| Example 7 | 7 | A | A | 1.1 | B | 2.2 |
| Example 8 | 8 | B | A | 0.8 | A | 1.7 |
| Example 9 | 9 | C | A | 0.9 | B | 2.6 |
| Example 10 | 10 | B | A | 1.8 | B | 2.8 |
| Example 11 | 11 | A | A | 1.9 | C | 3.5 |
| Example 12 | 12 | C | A | 0.3 | A | 1.9 |
| Example 13 | 13 | A | A | 0.6 | B | 2.3 |
| Example 14 | 14 | C | A | 0.9 | B | 2.3 |
| Example 15 | 15 | B | A | 1.1 | C | 3.4 |
| Example 16 | 16 | B | A | 0.5 | A | 1.6 |
| Example 17 | 17 | C | A | 0.4 | B | 2.1 |
| Example 18 | 18 | A | A | 0.7 | B | 2.2 |
| Example 19 | 19 | B | A | 0.8 | B | 2.4 |
| Example 20 | 20 | B | A | 0.6 | B | 2.1 |
| Example 21 | 21 | A | A | 1.3 | B | 2.8 |
| Example 22 | 22 | A | A | 1.5 | C | 3.1 |
| Comparative example 1 | 23 | D | A | 1 | B | 2.8 |
| Comparative example 2 | 24 | D | A | 1.1 | C | 3.5 |
| Comparative example 3 | 25 | D | B | 2.1 | D | 4.5 |
| Comparative example 4 | 26 | D | B | 2.2 | D | 4.3 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-046883, filed Mar. 14, 2019, which is hereby incorporated by reference herein in its entirety.

What is claimed is:

1. A toner, comprising:

a toner particle; and an external additive comprising spherical silica particles having a circularity of at least 0.80 and hydrotalcite particles, wherein a ratio Db/Da of a number average particle diameter Db (nm) of the hydrotalcite particles to a number average particle diameter Da (nm) of the spherical silica particles is 7.5 to 30.0, the number average particle diameter Da (nm) of the spherical silica particles is 10 to 40, and $$\{Ga\times(1-Ka/100)\}/\{Gb\times(1-Kb/100))\geq 0.050$$

where Ga is a content of the spherical silica particles with respect to 100 parts by mass of the toner particle, Gb is a content of the hydrotalcite particles with respect to 100 parts by mass of the toner particle, Ka is a fixing ratio (%) of the spherical silica particles on a surface of the toner particle and Kb is a fixing ratio (%) of the hydrotalcite particles on the surface of the toner particle.

2. The toner according to claim 1, wherein $$6.000\geq\{Ga\times(1-Ka/100)\}/(Gb\times(1-Kb/100)\}\geq 0.050.$$

3. The toner according to claim 1, wherein Ka is 60 to 95.

4. The toner according to claim 1, wherein Kb is 15 to 70.

5. The toner according to claim 1, wherein Db is 100 to 1000 nm.

6. The toner according to claim 1, wherein the content of the spherical silica particles is 0.10 to 5.00 parts by mass with respect to 100 parts by mass of the toner particle.

7. The toner according to claim 1, wherein the content of the hydrotalcite particles is 0.05 to 1.00 parts by mass with respect to 100 parts by mass of the toner particle.

8. The toner according to claim 1, wherein the toner particle is an emulsion aggregation toner particle.

9. The toner according to claim 1, wherein the spherical silica particles are sol-gel silica particles.

* * * * *